United States Patent [19]

Breen

[11] Patent Number: 4,860,945

[45] Date of Patent: Aug. 29, 1989

[54] FAN-FOLDED, MULTIPLE COUPON/ENVELOPE FORM SET AND METHOD OF MAKING SAME

[75] Inventor: Thomas J. Breen, Northbrook, Ill.

[73] Assignee: National Computer Print, Inc., Birmingham, Ala.

[21] Appl. No.: 129,727

[22] Filed: Dec. 7, 1987

[51] Int. Cl.[4] ..... B65D 27/10

[52] U.S. Cl. ..... 229/69; 229/70; 493/187; 493/216; 493/245

[58] Field of Search ..... 229/69, 70; 493/187, 493/216, 244, 245; 282/11.5 R, 11.5 A, 25, DIG. 1

[56] References Cited

U.S. PATENT DOCUMENTS

| | | | |
|---|---|---|---|
| 791,362 | 5/1905 | Parmenter | 229/70 |
| 1,171,703 | 2/1916 | Cather | 229/70 |
| 1,401,324 | 12/1921 | Dority et al. | 282/25 |
| 2,112,227 | 3/1938 | Berkowitz | 229/70 |
| 2,154,736 | 4/1939 | Endres | 229/69 |
| 2,257,766 | 10/1941 | Sherman | 229/69 |
| 2,304,523 | 12/1942 | Young | 229/69 |
| 2,413,649 | 12/1946 | Overly | 229/69 |
| 2,855,138 | 10/1958 | Hopkin | 229/70 |
| 3,237,970 | 3/1966 | Mudd, Jr. | 282/25 |
| 3,253,545 | 5/1966 | Carleton | 282/25 |
| 3,356,285 | 12/1967 | Greason | 229/70 |
| 3,665,817 | 5/1972 | Katz et al. | |
| 3,713,673 | 1/1973 | Katz | |
| 3,743,273 | 7/1973 | Katz et al. | |
| 3,784,185 | 1/1974 | Katz | |
| 3,866,822 | 2/1975 | Faltin et al. | 229/69 |
| 3,900,159 | 8/1975 | Gendron | 229/69 |
| 4,530,730 | 7/1985 | Bradley et al. | |
| 4,586,651 | 5/1986 | Bradley | |
| 4,630,768 | 12/1986 | Bradley | |

OTHER PUBLICATIONS

The American Traveler return mail envelope specimen.
Execu-Charge Visa envelope-coupon specimen.
Mortgage Payment Book specimen.

*Primary Examiner*—Stephen P. Garbe
*Attorney, Agent, or Firm*—Dressler, Goldsmith, Shore, Sutker & Milnamow, Ltd.

[57] ABSTRACT

A fan-folded form set comprising a plurality of joined coupon/envelope members which are severable from adjacent coupon/envelope members along lines of perforation, and which coupon/envelope members are separable from each other. Each coupon/envelope is associated for a use, and each of the coupon/envelope members are related to the others in the set. The coupon/envelope members may be largely related in sequence. A method of producing the fan-folded form set and successive such form sets is described.

13 Claims, 4 Drawing Sheets

FAN-FOLDED, MULTIPLE COUPON/ENVELOPE FORM SET AND METHOD OF MAKING SAME

BACKGROUND OF THE INVENTION

Payment books, such as mortgage and installment payment books, usually come in multiple, sequenced sets of coupons bound at one side, with the stubs bound and the coupons severable from the stubs along lines of perforations. A coupon, once separated, is then placed in an envelope, as with a payment, the envelope is sealed and is mailed to the payment recipient.

Payment books of that type require printed stub/coupons, binding at one side, and a separate stack or assemblage of envelopes for payment. Thus, printing, collating and binding operations are required to prepare such books, followed by packaging same with envelopes for transmittal to the payor for payor's use.

It would be of advantage to provide a multiple form set for sequential payments by a payor, in which the sequential forms of the set are collated without a binding process and which are easy to produce in accordance with currently available technology, and which form sets may be formed one after the other for ready separation from each other after they have been formed.

SUMMARY OF THE INVENTION

In accordance with the present invention a form set, such as a fan folded form set comprising a plurality of coupon/envelope forms for periodic use in a fan-folded array is provided. The coupons are integrally formed and separable, each from the next, along lines of perforations, each coupon being related to but differing from the next adjacent coupon. An envelope is associated with and secured to, but separable from, each coupon. In one form, the envelopes may be secured, each to the next envelope, along lines of perforations aligned with the coupon lines of perforations, and, when the coupons and envelopes are integrally formed, each associated envelope and coupon is separable from the other along a line of serrations. In one form the envelopes and coupons are integrally formed and in another form the envelopes and associated coupons are secured to each other by an adhesive. Desirably the coupons differ, each from the next, by personalized sequential variable data.

In another aspect of the present invention a fan-folded form set comprising a plurality of coupon/envelope forms for periodic use in a fan-folded array is provided with the envelopes being integrally formed and separable, each from the next, along lines of perforations, and with a coupon associated with and secured to, but separable from, each envelope, each coupon being related to, but differing from, the next adjacent coupon, and wherein the envelopes and associated coupons are secured to each other by an adhesive.

In another aspect of the present invention a form set having a plurality of coupon/envelope forms, each comprising an envelope and coupon is provided. Each envelope has a closed bottom edge and sealed side edges, and is formed of a first panel for providing an address, the first panel defining an envelope front panel, a second panel for defining an envelope back panel and sealingly joined to the first panel, the panels defining an envelope bottom and envelope side edges, and a sealing flap secured to one of the first and second panels along a fold line for confronting a surface of the other of the panels. Adhesive is disposed on one of the sealing flap and the other panel for sealing closure of the envelope along an edge opposite the bottom edge.

Each of the plurality of envelopes is formed with a next adjacent envelope along a line of perforations. A separable associated printed coupon is secured to each envelope for separation therefrom. The coupon may be secured to the next adjacent printed coupon along a line of perforations. The coupon is adapted for insertion in its associated envelope, each adjacent coupon being related by data thereon, and desirably differing from the next adjacent coupon in the set, as by personalized sequential variable data. The printed coupon may be integrally formed with its associated envelope, as along a line of severance therebetween for separation of the coupon from the envelope along the line of severance.

The preferred printed coupon may comprise a coupon portion and a stub portion which are together separable from its associated envelope along the line of severance, and which are separable from each other along a second line of severance, which lines of severance preferably are lines of perforations.

In one aspect, the coupons may be integral but separately formed from said envelopes, and are secured to associated envelopes in an overlaid array, defining lines of perforations aligned with the envelope lines of perforations.

This invention also provides an improved method of continuously forming a series of sequenced multiple members of a form set of coupon/envelopes, and includes the steps of providing continuous form paper stock, and imprinting the stock with information. The information, in a first zone, is constant to provide envelope data, and in a second zone is in part personalized constant information and in part personalized sequential information relative to the next preceeding and next succeeding member of the set, thereby to provide coupon data. Each member of the set may be joined to the next preceeding and next succeeding member of the set along a line of perforations.

The method also comprises forming an envelope in the second zone by defining front and back panel members sealingly joined, as along a fold line, for forming a closed lower edge of an envelope, applying adhesive to selected portions of one of the panel members so that when the front and back panel members are juxtaposed by folding along the fold line, opposite closed side edges of the envelope are provided, providing a sealing flap joined to one of the panel members for folding over a top edge of the other of the panel members for closing the top edge of the envelope, and applying adhesive to one of the sealing flap and a confronting other panel member for adhesively closing the envelope, and providing a severance line for severing the second coupon zone from the envelope, thereby to provide a separated coupon to be inserted in the envelope. In one form, the severance line and the fold lines are formed in an array which is generally perpendicular to the lines of perforations, and the form set is imprinted to vary from member to member only by the personalized sequential information, with the members of the set being arrayed in fan-folded form.

In the preferred method of manufacture, the method comprises sequentially forming succeeding form sets of multiple members along adjacent lines of perforations, the form sets varying from one form set to the next by the personalized information, and then separating each form set from the preceeding form set.

In one form of the present invention the method of making a form set comprising a plurality of coupon/envelope forms in a fan-folded array, the steps comprise forming a plurality of printed coupons continuously, each coupon being related to but differing from the next adjacent coupon, forming a line of perforations between each coupon for separation of each coupon from its next adjacent coupon, providing an envelope associated with and secured to, but separable from, each coupon, and fan-folding the coupon/envelope forms into a compact pack. The envelopes may also be secured, each to the next envelope, by providing lines of perforations aligned with the coupon lines of perforations, and each associated envelope and coupon are separable from each other by providing a line of serrations. The method may associate the coupons and envelopes by temporarily securing the envelopes and associated coupons to each other by applying an adhesive therebetween. In the preferred method, the method comprises the further steps of continuously forming a plurality of form sets in line with each other, and then separating one form set from the next succeeding form set prior to fan-folding same into a compact pack.

In a related aspect of the present invention the method of making a form set comprising a plurality of coupon/envelope forms in a fan-folded array, includes forming a plurality of envelopes continuously, the envelopes being integrally formed and separable, each from the next, along lines of perforations, forming a set of printed coupons, each coupon being related to but differing from the others in the set of printed coupons, securing a coupon to each of the envelopes, and then fan-folding the coupon/envelopes into a compact pack. The method may also comprise the step of temporarily securing the envelopes and associated coupons to each other by applying an adhesive therebetween, and the further steps of continuously forming a plurality of form sets in-line with each other, and then separating one form set from the next succeeding form set prior to fan-folding same into a compact pack.

Further objects, features and advantages of the present invention will become apparent from the following description and drawings.

DETAILED DESCRIPTION OF THE PREFERRED EMBODIMENT

Figure 1:
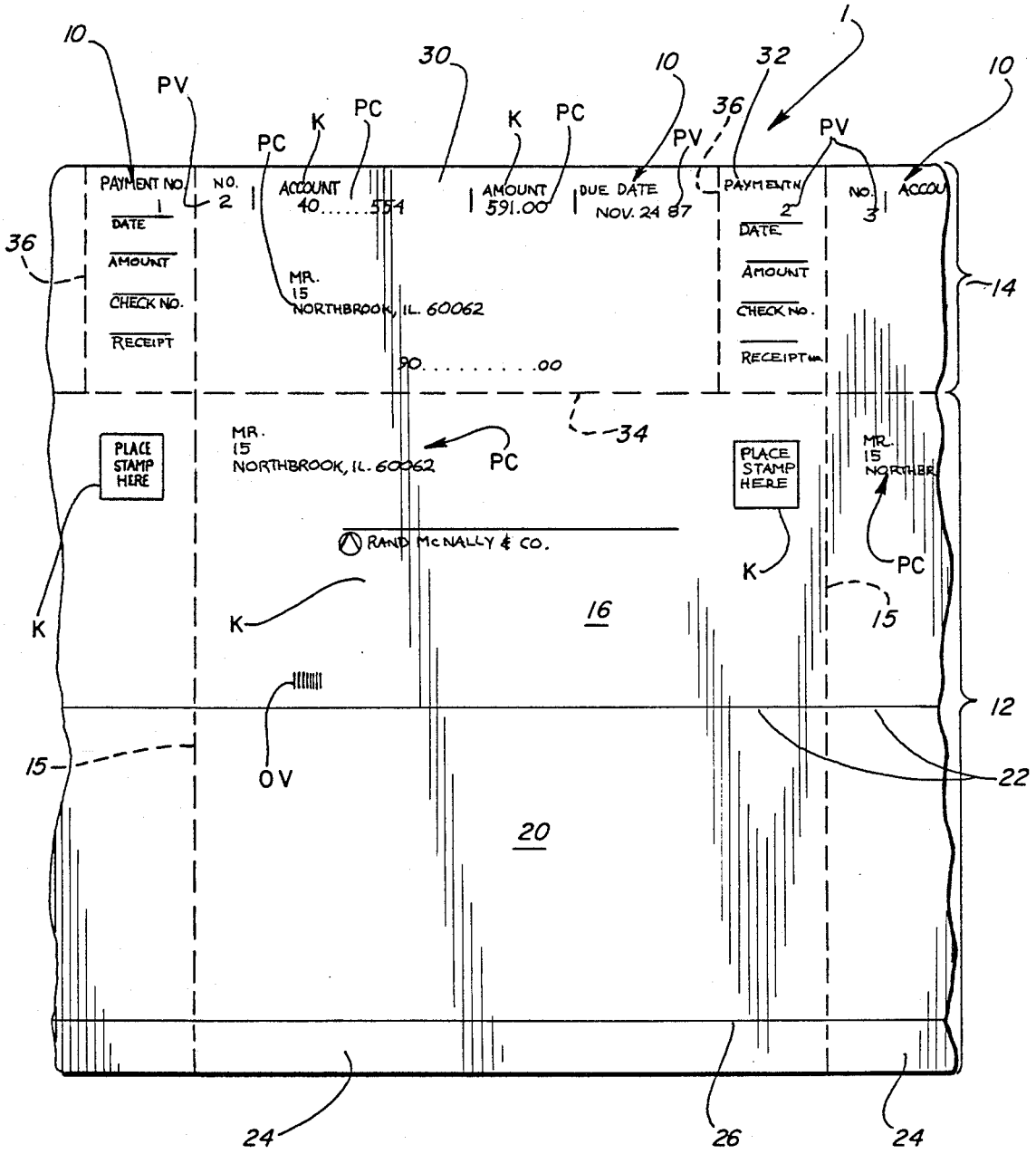
FIG. 1 is a plan view of a fan-foldable form set of the present invention, including sequenced coupon members, shown prior to fan-folding.
Figure 2:
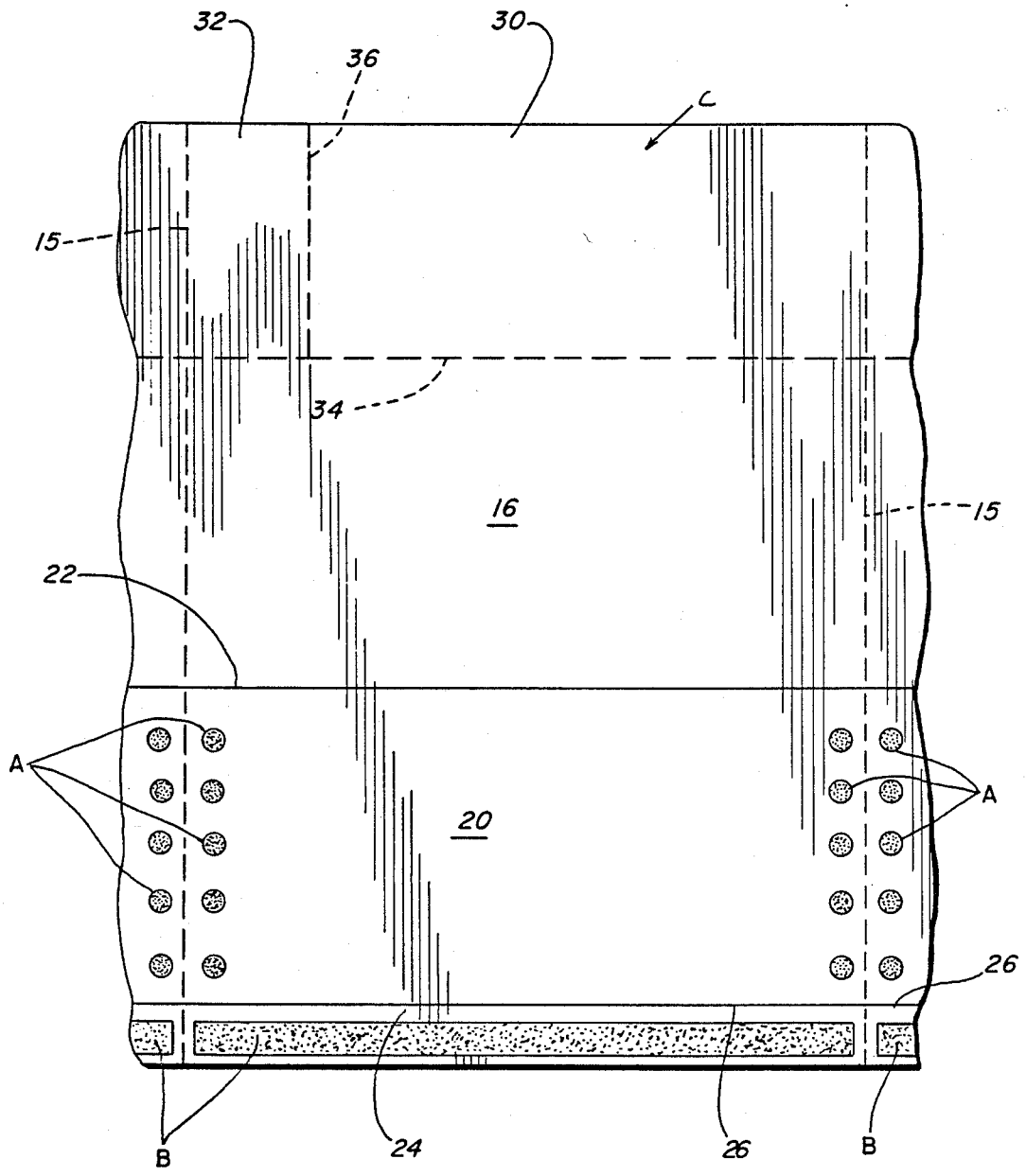
FIG. 2 is a rear view of the form set of FIG. 1.

Referring now to the drawings, a presently preferred embodiment of a typical form set 1 of sequenced members of a set of coupon/envelope forms for periodic use in accordance with this invention is illustrated in FIGS. 1–4, and is seen to comprise a sequential series of forms 10, each comprising a first envelope zone 12 and second coupon zone 14. The forms 10 are severable from each other along score lines, such as lines 15 of perforations or serrations.

The envelope zone 12 comprises a first panel 16 which may provide constant information or data K, data which may be constant from set to set, such as an address, and personalized constant data PC, such as a return address, which is constant for the set, and a second panel 20 sealingly joined to the first panel 16. Second panel 20 may be blank to serve as a back of an envelope, while panel 16 may serve as the front of an envelope. Panels 16, 20 are sealingly joined to each other, as along a fold line 22, which may serve as the lower horizontal closed bottom edge of the envelope.

In the embodiment illustrated, a glue or sealing flap 24 is formed with the envelope zone and is joined with back panel 20, as along a fold line 26 which may be pre-creased. Thus, flap 24 as shown is adapted to be folded over the upper front horizontal edge of panel 16 to confront and sealingly close the envelope at the top edge when it is to be used.

Figure 3:
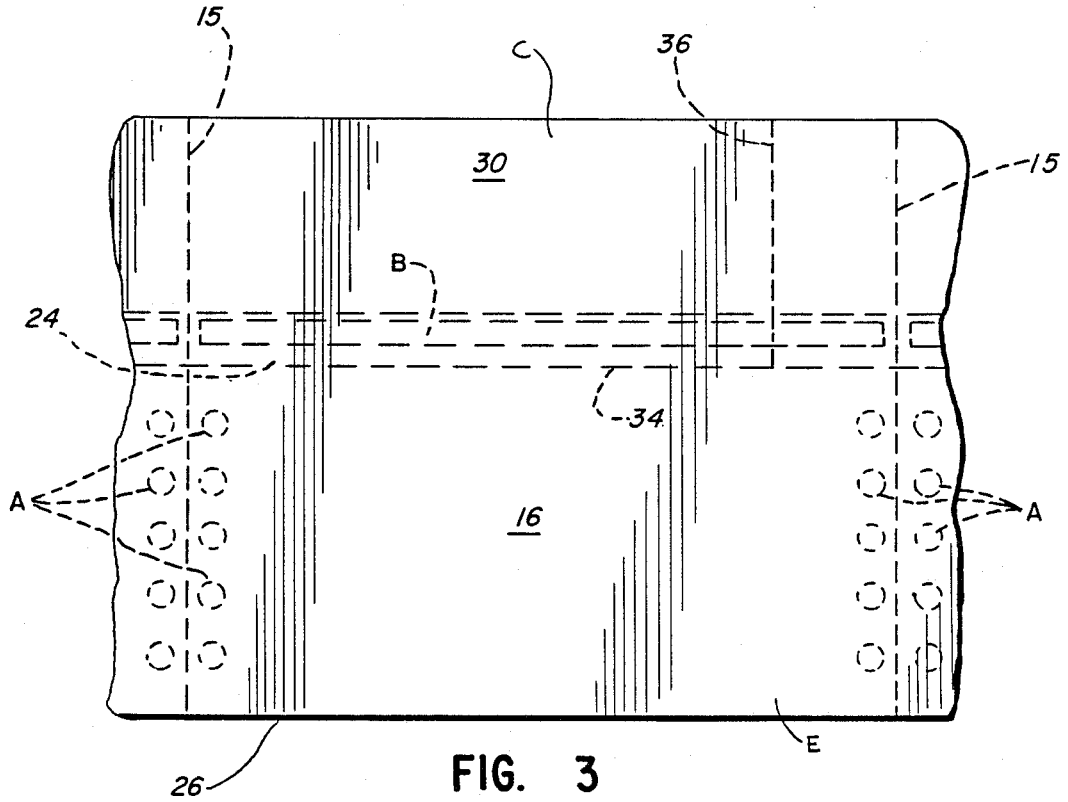
FIG. 3 is a plan view of the form set of FIG. 1, with the envelope members folded and formed, also prior to fan-folding edges.
Figure 4:
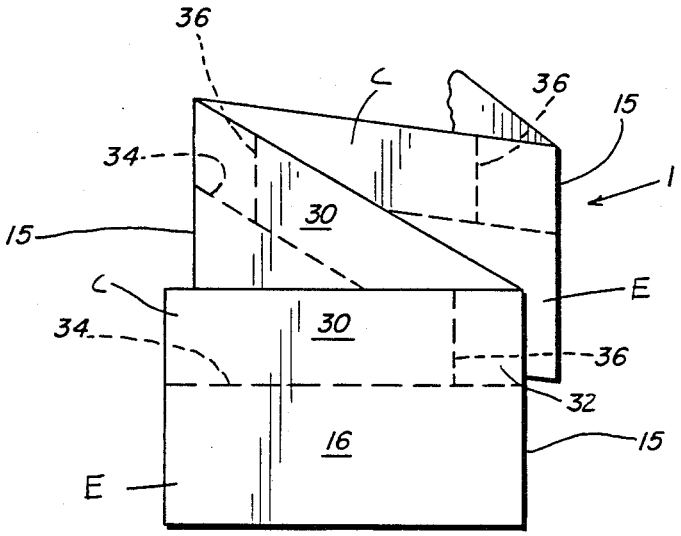
FIG. 4 is fan-folded form set of FIG. 3.

The envelope E itself is formed by providing adhesive A (FIG. 2) intermediate the confronting surfaces of the front and back panels 16, 20 when they are juxtaposed, thereby to provide closed envelope side edges (see FIG. 3). Adhesive A may be a hot melt adhesive and may be applied in a customary manner known to those working in the field to either of panels 16 of 20. An adhesive B may be applied either to the sealing flap 24 or to the surface of the envelope to which the sealing flap 24 is to be secured. Adhesive B may be pressure sensitive or activatible by moistening and may be applied in a known manner.

In FIG. 1 the coupon zone 14 which is integral with the envelope along the line of severance is seen to comprise a coupon C including coupon portion 30 and a stub portion 32. Each of the coupon 30 and stub 32 contains additional constant data or information K, which is constant from one form set 1 to the next adjacent form set 1, as well as personalized constant data PC which may be constant from one form 10 in a set to the next form in the set, and other data which is sequential from one form 10 in a set 1 to the next form 10 in that set, which data or information is designated as personalized variable data PV. Thus, typically for a mortgage loan payment form set usable say for a twelve month period, adjacent form sets 1 may have constant form information including wording such as "account number", the addressee on the envelope portions and the like, a single form set 1 for a particular customer may have constant personalized information PC including the name and address of the mortgagor, his particular account number, his address on the envelope, and the specific amount due. Within that form set, each form will be different and may have sequenced data or variable personalized data PV, such as the due date and the payment number.

The coupon C, namely the coupon portion 30 and stub portion 32 are severable from the envelope E in "bangtail" fashion, i.e., are severable along a score line of severance comprising a line of perforations or serrations 34. Similarly, a line of severance or perforations 36 is provided to separate the coupon portion 30 from the stub portion 32. Lines 36 and the lines of folding for the envelope are all arrayed generally perpendicularly to the lines of perforation 15.

Also in accordance with the present invention, other variable data OV may be applied, as to the envelope. Thus, in a given set, the envelopes may be coded as by a bar code, a UPC code, differing return addresses and the like to indicate what is inside the envelope, such as payment, a change of address, etc. Thus, one of the coupon/envelopes in the set may be other than the sequenced group, such as for special purposes. Alternatively, a space might be provided on the envelopes E for marking them to signify that it is being cued for an additional purpose, such as a change of address. However, in all cases the purpose and result of the practice of the invention is to always associate the correct coupon with the correct type of envelope and always to associate a coupon C and envelope E, thereby to assure accuracy and to minimize excuses by the users and the attendant costly expense to the issuer of the form sets.

As will be apparent, in accordance with the present invention the plurality of severable coupon/envelopes which are severable along lines of severance define coupon/envelope pairs which are matched and customized for a particular purpose, even if they differ in purpose from the next adjacent coupon/envelope in the form set. Thus as stated, a thirteenth coupon/envelope in a set can be a change of address coupon where the envelope goes to an address (or lock box) different from that to which the 12 payment envelopes go. Other special purpose coupon/envelopes may be used as well. Of course, in addition to providing one properly addressed envelope for each coupon, this invention avoids the need for separate bundles of envelopes for the coupons. Thus, conventional envelope schemes use 6 or 12 packs of envelopes in banded bundles. If there are 13 coupons, the envelopes shipped are typically too few or too many, producing either waste or insufficient envelopes for the purpose.

Thus, the present invention minimizes waste and exactly and automatically keys each coupon and its purpose to the correct envelope with the correct address for all coupon/envelopes in the form set. Also, the manner and form of printing the selected data assures that each associated coupon/envelope in the set, whether sequenced or special purpose, is properly tied together.

In a typical form set in accordance with this invention, a typical sequenced member form set may include 12 sequenced coupon/envelope members for sequential payments, addressed with constant lock box information K. A next adjacent member of the form set may comprise a change of address coupon/envelope, with different address, such as to the bank customer service department. Another coupon/envelope member could be a questionaire to be mailed to yet another address imprinted on the envelope which might be a survey organization. Other coupon/envelope members with yet other addresses may be used as well for special purposes. Indeed a special coupon/envelope member may comprise a yearly summary or statement of account for the customer to keep, in which event the customer would discard any associated envelope section which, of course in that instance would not have a mailing address.

Although, as pointed out above, current methods accomodate to variable coupons, they do not accomodate to varying envelope addresses because they are fixed. This, in a form set is a very important feature.

A typical sequenced member form set 1 may be produced in a fan-folded assemblage, as will now be described. A source of typical continuous form stock paper for the purpose is provided. It may then be suitably imprinted, as with the printed constant information K which is to appear on the envelope E (such as envelope data which may be constant) and on the coupon stub.

Adhesive A and B is suitably applied to, and disposed on rear surfaces of the forms 10, as to one of the envelope panels 16, 20 and to the sealing flap 24, following which the second or back panel 20 is folded along fold line 26 to confront the front panel 16 and to adhere panels 16, 20 to each other along their side edges. The stock may also be pre-creased, such as at the sealing flap fold line 26 to facilitate later folding of the sealing slap 24.

The stock may then be perforated to provide the lines of perforations for separation of the coupon C from the envelope, and for separation of the stub portion 32 from the coupon portion 30, as well as for fan-folding of the forms 10 relative to each other. At this point, in a typical process, the forms exit the printing press and associated equipment.

Thereafter (or therebefore), the form set is properly imaged, as by laser printing, as with the personalized constant information PC and personalized sequential variable information PV to produce a form set 1 which is distinguished from the next adjacent form set 1. In that regard, the envelopes E of a form set 1 may be imprinted with a return address for an individual set 1. The coupon and stub portions in each member of set 1 may be imprinted with personalized constant information, such as the particular account number, the name and address, the loan amount, etc., and the coupon/stub portions in each member of the set may be imprinted with the sequential personalized variable information PV, such as the due dates and payment numbers. Typically the members of a set may comprise 12 in number, such as one coupon/envelope member for each of twelve months, each having a printed coupon C secured to the next along a line of perforations, and each coupon C being related to the next adjacent coupon C by the data appearing thereon, as by differing from the next adjacent coupon C in the set by personalized sequential variable data.

Of course, the next adjacent form sets 1 will be similarly formed and provided with the same constant data K, but different personalized constant data PC and appropriate sequenced personalized variable data PV and will later be separated from the preceeding and succeeding form sets 1 along lines of perforation 15 to provide individual fan-folded form sets 1. Within individual form sets 1 it is possible to provide them in separated stacks rather than in a fan-folded stack.

Thus, following formation and printing of the sets of sequenced form members, each set 1 is separated from the next succeeding adjacent set 1 and, in fan-folded form or otherwise are packaged as a compact pack, as in an envelope, as for transmittal to a payor for the payor's use.

The particular sequence of steps of formation referred to need not necessarily be followed. For example, the personalized information may be imprinted prior to folding of the second panels along the fold line 22. Imprinting of the information which is constant for adjacent form sets may occur after perforating. Other variations in the order of forming the form sets 1 will be apparent to those skilled in the art.

It is also apparent, for example, that the sealing flap may be disposed at the upper edge of the envelope front panel and that the coupon/stub may be joined to the sealing flap along a line of perforations for severance therefrom in use.

It may be desirable to form an envelope with different paper stock comprising the front and back panels. That is ofttimes done to meet autoscanner and postal rate "in weight" needs. For lock box operations the coupon and front envelope panel should be scannable and as such typically are of 20 pound scannable grade paper. However, to keep overall weight down, say for a package of 15 envelope/coupons, to under two ounces, the rear panel might desirably be 12 pound paper, a light grade. Where different stocks are used, one of the panels, such as the front panel, may be formed with the coupon, and the other or back panel may be separately formed. In that case the continuous series of front panels and coupons may be printed, provided with adhesive, such as for the sealing flap, and then removed from the press area.

Thereafter one side of the panel/coupon or back panel may be provided with adhesive, they are collated, matched and adhered, and thereafter perforated. Next they are suitably imaged (printed) as described with the remaining data to be applied. Finally, each set is separated from the next adjacent set, fan-folded, and readied for shipment in that compact interconnected form to the customer or user. This in-line process provides all of the same advantages as the one-piece form set process, but with the advantage of permitting the use of different grades of paper.

In yet another variation of the prevent invention, envelopes may be formed in the manner described and may then be overlaid and collated with printed coupons providing suitable constant data K, personalized constant data PC and personalized sequential data PV. The coupons may be secured, as by a low-tack adhesive to the envelope, as in the sealing-flap zone, for later removal along a line of perforation, like that described in connection with FIGS. 1-4.

Figure 5:
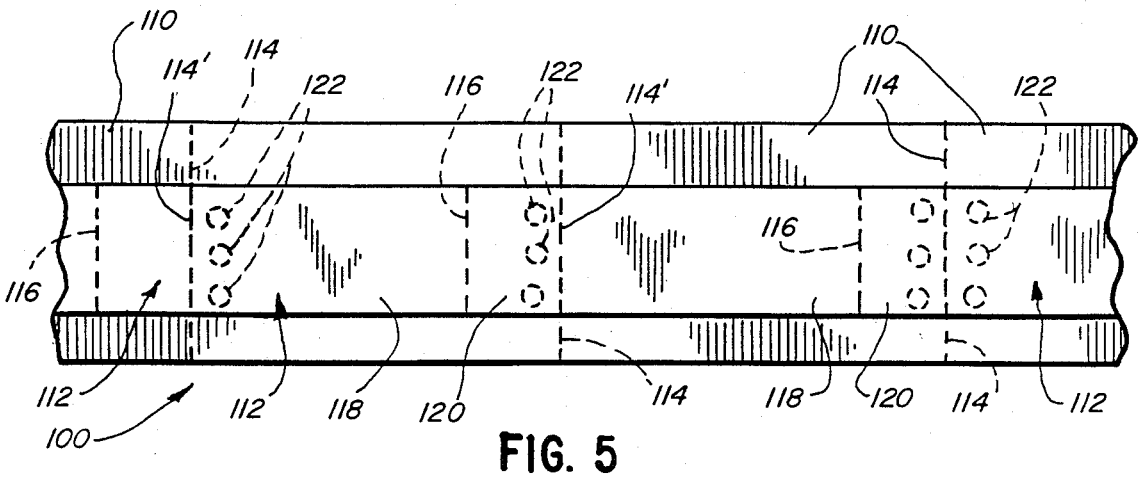
FIG. 5 is a plan view of a further embodiment of a fan-foldable form set of the present invention, including sequenced coupon members, shown prior to fan-folding.
Figure 6:
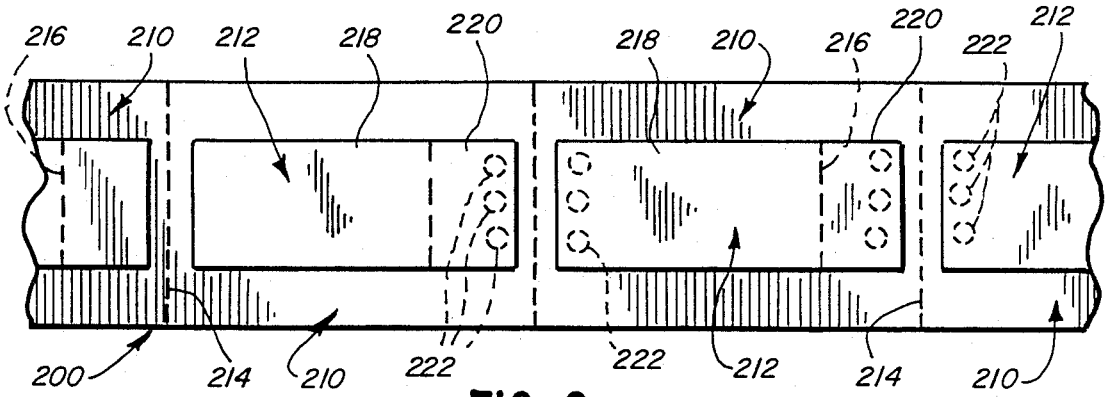
FIG. 6 is a plan view of another embodiment of a fan-foldable form set the present invention, including sequenced coupon members, shown prior to fan-folding.
Figure 7:
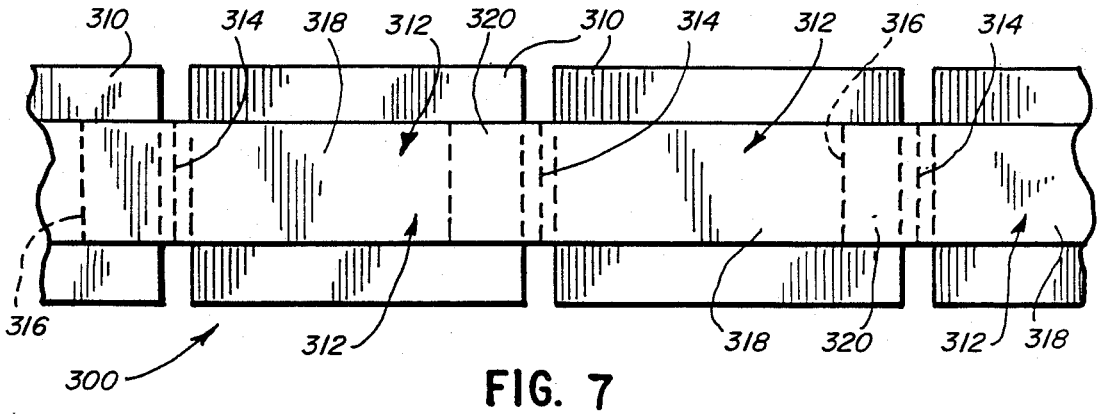
FIG. 7 is a plan view of yet another embodiment of a fan-foldable form set of the present invention, including sequenced coupon members, shown prior to fan-folding.

Alternative form sets in accordance with the present invention are typically illustrated in FIGS. 5, 6 and 7.

Referring first to FIG. 5, a form set 100 is seen to comprise a series of sequential members of a set of coupon/envelopes comprising continuously formed integral envelopes 110 and continuously formed coupons 112 overlaid on the envelopes. Envelopes 110 may be formed as are the envelopes of FIGS. 1-4, and with lines of perforations 114 or severance along which they may be separated. Coupon 112 may be formed by suitable imprinting, and may preferably be formed also with a line of severance or perforations 116 to provide a coupon portion 118 and a stub portion 120 for purposes and uses already described.

Envelopes 110 and coupons 112 are temporarily secured to each other, as by a low-tack adhesive for easy removal and separation of one from the other. Thus two lines of low-tack adhesive, shown in FIG. 5 in dotted line as adhesive dots 122, may be applied intermediate the coupon and envelope for temporary securance.

Although the lines of severance or perforations 114 and like lines of perforations 114' for separating adjacent coupons may be separately formed, so that they are in-line when one coupon/envelope member is to be removed from the remainder of the pack, it is preferable to perforate both at the same time. Once the coupon/envelope form set has been completed, the members are fan-folded into a compact pack.

Further, although it is not shown in FIG. 5, the types of data K, PC, PV, and OV applied variously to the envelopes and coupons of the embodiment of FIGS. 1-4 may be used in the same way in FIG. 5. As such they have not been illustrated in FIG. 5.

Referring now to FIG. 6, a form set 200 is seen to comprise a series of sequential members of a set of coupon/envelopes comprising continuously formed integral envelopes 210 and sequentially formed coupons 212 overlaid on the envelopes. Envelopes 210 may be formed as are the envelopes of FIGS. 1-4, and with lines of perforations 214 or severance along which they may be separated. Coupons 212 may be formed by suitable imprinting, and may preferably be formed also with a line of severance or perforation 216 to provide a coupon portion 218 and a stub portion 220 for purposes and uses already described.

Envelopes 210 and coupons 212 are temporarily secured to each other, as by a low-tack adhesive for easy removal and separation of one from the other. Thus two lines of low-tack adhesive, shown in FIG. 6 in dotted line as adhesive dots 222, may be applied intermediate the coupon and envelope for temporary securance. Once the members are completed and printing is completed, the form set 200 is fan-folded into a compact pack.

Further, although it is not shown in FIG. 6, the types of data K, PC, PV, and OV applied variously to the envelopes and coupons of the embodiment of FIGS. 1-4 may be used in the same way in FIG. 6. As such they have not been illustrated in FIG. 6.

Referring now to FIG. 7, a form set 300 is seen to comprise a series of sequential members of a set of coupon/envelopes comprising envelopes 310 and continuously formed, integral sequential coupons 312 overlaid on the envelopes. Envelopes 310 may be separately formed in any suitable manner. Coupons 312 may be formed by suitable imprinting, and are preferably formed with a line of severance or perforations 316 to provide a coupon portion 318 and a stub portion 320 for purposes and uses already described. Coupons 312 also define a line of perforations 314 between each adjacent coupon for severance of each from the next.

Envelopes 310 and coupons 312 are temporarily secured to each other, as by a low-tack adhesive for easy removal and separation of one from the other. Thus two lines of low-tack adhesive, shown in FIG. 7 in dotted line as adhesive dots 322, may be applied intermediate the coupon and envelope for temporary securance. After completion of the assembly of the coupon/envelopes, they are fan-folded into a compact pack.

Although it is not shown in FIG. 7, the types of data K, PC, PV, and OV applied variously to the envelopes and coupons of the embodiment of FIGS. 1-4 may be used in the same way in FIG. 7. As such they have not been illustrated in FIG. 7.

It is therefore apparent that a variety of modifications may be incorporated in accordance with the present invention to provide coupon/envelope form sets which provide substantial advantages over what is presently available. Matching coupon/envelopes keyed to proper, and sometimes differing addresses for special purposes, produce economies in manufacture, mailing and processing which are highly advantageous. It should be understood, however, that the coupons in a set may be related, but not necessarily always entirely sequential, as, for example is an added statement or change of address coupon to a set which is otherwise sequential for periodic payments.

Although only certain embodiments have been illustrated and described herein it will be apparent to those skilled in the art that variations may be made without departing from the spirit or scope of the invention. Accordingly, the invention is not to be limited by the description, but rather is to be construed in the context of the appended claims.

What is claimed is:

1. A form set having a plurality of coupon/envelope forms, each comprising:

an envelope having a closed bottom edge and sealed side edges formed of a first panel for providing an address, said first panel defining an envelope front panel, a second panel for defining an envelope back panel and sealingly joined to said first panel, said panels defining an envelope bottom and envelope side edges, and a sealing flap secured to one of said first and second panels along a fold line for confronting a surface of the other of said panels, adhesive disposed on one of said sealing flap and said other panel for sealing closure of said envelope along on edge opposite said bottom edge, each of said plurality of envelopes being formed with a next adjacent envelope along a line of perforations, a separable associated printed coupon secured to each said envelope for separation therefrom, and secured to the next adjacent printed coupon along a line of perforations, said coupon being adapted for insertion in its associated envelope, each said coupon differing from the next adjacent coupon in the set by personalized sequential variable data, said printed coupon being integrally formed with its associated envelope, and a line of severance therebetween for separation of said coupon from said envelope along said line of severance, and wherein each said printed coupon comprises a coupon portion and a stub portion which are together separable from its associated envelope along said line of severance and which are separable from each other along a second line of severance.

2. A form set in accordance with claim 1, and wherein said lines of severance are lines of perforations.

3. A form set in accordance with claim 1, and further comprising adhesive between said first and second panels at each side edge to define sealed envelope side edges.

4. A form set in accordance with claim 3, and wherein said first and second panels are integral and said bottom edge is a fold line sealingly joining said first and second panels.

5. A form set in accordance with claim 1, and wherein each said envelope and associated coupon is fan-folded with respect to the next adjacent envelope and associated coupon.

6. A form set having a plurality of coupon/envelope forms, each comprising:

an envelope having a closed bottom edge and sealed side edges formed of a first panel for providing an address, said first panel defining an envelope front panel, a second panel for defining an envelope back panel and sealingly joined to said first panel, said panels defining an envelope bottom and envelope side edges, and a sealing flap secured to one of said first and second panels along a fold line for confronting a surface of the other of said panels, adhesive disposed on one of said sealing flap and said other panel for sealing closure of said envelope along an edge opposite said bottom edge, each of said plurality of envelopes being formed with a next adjacent envelope along a line of perforations, a separable associated printed coupon secured to each said envelope for separation therefrom, and secured to the next adjacent printed coupon along a line of perforations, said coupon being adapted for insertion in its associated envelope, each said coupon differing from the next adjacent coupon in the set by personalized sequential variable data, and wherein each said printed coupon comprises a coupon portion and a stub portion which are together separable from its associated envelope along said line of severance and which are separable from each other along a second line of severance.

7. A method of continuously forming a series of sequenced multiple members of a form set of coupon/envelopes, comprising the steps of providing continuous form paper stock, imprinting said stock with information which in a first zone is constant to provide envelope data, and which in a second zone is in part personalized constant information and in part personalized sequential information relative to the next preceding and next succeeding member of the set, thereby to provide coupon data, and wherein each member of the set is joined to the next preceding and next succeeding member of the set along lines of perforations, except that the first and last members of the set are joined only to the next succeeding and next preceding members, respectively, forming an envelope in said second zone by defining front and back panel members joined along a fold line for forming a closed lower edge of an envelope, applying adhesive to selected portions of one of said panel members so that when the front and back panel members are juxtaposed by folding along said fold line, opposite closed side edges of said envelope are provided, providing a sealing flap joined to one of the panel members for folding over a top edge of the other of said panel members for closing the top edge of the envelope, and applying adhesive to one of said sealing flap and a confronting other panel member for adhesively closing the envelope, and providing a severance line for severing said second coupon zone from said envelope, thereby to provide a separated coupon to be inserted in said envelope.

8. A method of forming a series of sequenced members of a set of coupon/envelopes in accordance with claim 7, and wherein said severance line and said fold lines are formed in an array which is generally perpendicular to said lines of perforations, and wherein said form set is imprinted to vary from member to member only by the personalized sequential information, the numbers of the set being arrayed in fan-folded form.

9. A method of forming a series of sequenced members of a set of coupon/envelopes in accordance with claim 8, and wherein the method comprises sequentially forming succeeding form sets of multiple members, which form sets are formed along adjacent lines of perforations, and which form sets vary from one form set to the next by the personalized information, and separating each form set from the preceeding form set.

10. A method of forming a series of sequenced members of a form set in accordance with claim 7, and wherein one member of said coupon/envelope form set is provided with envelope data and coupon data which is related, but different and non-sequenced to provide a separated coupon for a purpose different from the other coupons.

11. A method of making a form set having a plurality of coupon/envelope forms, the steps comprising:

forming a plurality of envelopes, each having a closed bottom edge and sealed side edges formed of a first panel for providing an address, said first panel defining an envelope front panel, a second panel for defining an envelope back panel and sealingly joined to said first panel, said panels defining an envelope bottom and envelope side edges, and a sealing flap secured to one of said first and second panels along a fold line for confronting a surface of the other of said panels, adhesive disposed on one of said sealing flap and said other panel for sealing closure of said envelope along an edge opposite said bottom edge, each of said plurality of envelopes being formed with a next adjacent envelope along a line of perforations.

imprinting a separable coupon which is secured to each said envelope for easy separation therefrom, each said coupon being secured to the next adjacent printed coupon along a line of perforations, each said coupon being adapted for insertion in its associated envelopes, each said coupon being imprinted differ from the next adjacent coupon in the set by personalized sequential variable data, and further comprising the steps of integrally forming a coupon with its associated envelope, and providing a line of severance therebetween for separation of said coupon from said envelope along said line of severance, and forming each said printed coupon with a coupon portion with a stub portion which are together separable from its associated envelope along said line of severance and which are separable from each other along a second line of severance.

12. A method of making a form set in accordance with claim 11, and wherein the steps of providing said lines of severance comprise providing lines of perforations.

13. A method of making a form set having a plurality of coupon/envelope forms, the steps comprising:

forming a plurality of envelopes, each having a closed bottom edge and sealed side edges formed of a first panel for providing an address, said first panel defining an envelope front panel, a second panel for defining an envelope back panel and sealingly joined to said first panel, said panels defining an envelope bottom and envelope side edges, and a sealing flap secured to one of said first and second panels along a fold line for confronting a surface of the other of said panels, adhesive disposed on one of said sealing flap and said other panel for sealing closure of said envelope along an edge opposite said bottom edge, each of said plurality of envelopes being formed with a next adjacent envelope along a line of perforations, imprinting a separable coupon which is secured to each said envelope for easy separation therefrom, each said coupon being secured to the next adjacent printed coupon along a line of perforations, each said coupon being adapted for insertion in its associated envelope, each said coupon being imprinted to differ from the next adjacent coupon in the set by personalized sequential variable data, and forming each said printed coupon with a coupon portion and a stub portion which are together separable from its associated envelope along said line of severance and which are separable from each other along a second line of severance.

* * * * *

UNITED STATES PATENT AND TRADEMARK OFFICE

CERTIFICATE OF CORRECTION

PATENT NO. : 4,860,945

DATED : August 29, 1989

INVENTOR(S) : Thomas J. Breen

It is certified that error appears in the above-identified patent and that said Letters Patent is hereby corrected as shown below:

IN THE CLAIMS:

Column 9, line 33, change "on" to --an--;

Column 10, line 66, change "lines" to --line--;

Column 11, line 2, change "numbers" to --members--;

Column 11, line 40, change "envelopes" to --envelope--;

Column 11, line 41, insert --to-- after "printed"; and

Column 12, line 5, change "with" to --and--.

Signed and Sealed this

Thirtieth Day of October, 1990

*Attest:*

HARRY F. MANBECK, JR.

*Attesting Officer*

*Commissioner of Patents and Trademarks*